US007136810B2

(12) United States Patent
Paksoy et al.

(10) Patent No.: US 7,136,810 B2
(45) Date of Patent: Nov. 14, 2006

(54) WIDEBAND SPEECH CODING SYSTEM AND METHOD

(75) Inventors: Erdal Paksoy, Richardson, TX (US); Alan V. McCree, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 833 days.

(21) Appl. No.: 09/920,479

(22) Filed: Aug. 1, 2001

(65) Prior Publication Data

US 2002/0052738 A1 May 2, 2002

Related U.S. Application Data

(60) Provisional application No. 60/239,731, filed on Oct. 12, 2000, provisional application No. 60/228,215, filed on Aug. 25, 2000, provisional application No. 60/206,156, filed on May 22, 2000.

(51) Int. Cl.
*G10L 19/04* (2006.01)

(52) U.S. Cl. ..... 704/219; 704/223; 704/229

(58) Field of Classification Search ..... 704/219, 704/223, 226–228, 500–504, 229, 233, 200.1; 375/130; 370/335
See application file for complete search history.

(56) References Cited

U.S. PATENT DOCUMENTS

| | | | | |
|---|---|---|---|---|
| 5,224,120 | A * | 6/1993 | Schilling | 375/130 |
| 5,341,397 | A * | 8/1994 | Gudmundson | 370/335 |
| 5,455,888 | A * | 10/1995 | Iyengar et al. | 704/203 |
| 5,974,380 | A * | 10/1999 | Smyth et al. | 704/229 |
| 5,978,762 | A * | 11/1999 | Smyth et al. | 704/229 |
| RE36,721 | E * | 5/2000 | Akamine et al. | 704/220 |
| 6,311,154 | B1 * | 10/2001 | Gersho et al. | 704/219 |
| 6,675,144 | B1 * | 1/2004 | Tucker et al. | 704/264 |
| 6,681,202 | B1 * | 1/2004 | Miet et al. | 704/214 |
| 2002/0072899 | A1 * | 6/2002 | Paksoy et al. | 704/219 |

* cited by examiner

*Primary Examiner*—Vijay Chawan
(74) *Attorney, Agent, or Firm*—Carlton H. Hoel; W. James Brady; Frederick J. Telecky, Jr.

(57) ABSTRACT

A speech encoder/decoder for wideband speech with a partitioning of wideband into lowband and highband, convenient coding of the lowband, and LP excited by noise plus some periodicity for the highband. The embedded lowband may be extracted for a lower bit rate decoder.

6 Claims, 8 Drawing Sheets

WIDEBAND SPEECH CODING SYSTEM AND METHOD

CROSS-REFERENCE TO RELATED APPLICATIONS

This application claims priority from provisional applications: Ser. Nos. 60/239,731, filed Oct. 12, 2000, 60/228,215, filed Aug. 25, 2000 and 60/206,156, filed May 22, 2000.

BACKGROUND OF THE INVENTION

The invention relates to electronic devices, and, more particularly, to speech coding, transmission, storage, and decoding/synthesis methods and systems.

The performance of digital speech systems using low bit rates has become increasingly important with current and foreseeable digital communications. Both dedicated channel and packetized-over-network (VoIP) transmission benefit from compression of speech signals. The widely-used linear prediction (LP) digital speech coding compression method models the vocal tract as a time-varying filter and a time-varying excitation of the filter to mimic human speech. Linear prediction analysis determines LP coefficients a(j), j=1, 2, . . . , M, for an input frame of digital speech samples {s(n)} by setting $$r(n)=s(n)-\Sigma_{M\geq j\geq 1}a(j)s(n-j) \quad (1)$$

and minimizing the energy $\Sigma r(n)^2$ of r(n) in the frame. Typically, M, the order of the linear prediction filter, is taken to be about 10–12; the sampling rate to form the samples s(n) is typically taken to be 8 kHz (the same as the public switched telephone network (PSTN) sampling for digital transmission); and the number of samples {s(n)} in a frame is often 80 or 160 (10 or 20 ms frames). Various windowing operations may be applied to the samples of the input speech frame. The name "linear prediction" arises from the interpretation of $r(n)=s(n)-\Sigma_{M\geq j\geq 1}\ a(j)s(n-j)$ as the error in predicting s(n) by the linear combination of preceding speech samples $\Sigma_{M\geq j\geq 1}\ a(j)s(n-j)$. Thus minimizing $\Sigma r(n)^2$ yields the {a(j)} which furnish the best linear prediction. The coefficients {a(j)} may be converted to line spectral frequencies (LSFs) for quantization and transmission or storage.

The {r(n)} form the LP residual for the frame, and ideally LP residual would be the excitation for the synthesis filter 1/A(z) where A(z) is the transfer function of equation (1). Of course, the LP residual is not available at the decoder; thus the task of the encoder is to represent the LP residual so that the decoder can generate an LP excitation from the encoded parameters. Physiologically, for voiced frames the excitation roughly has the form of a series of pulses at the pitch frequency, and for unvoiced frames the excitation roughly has the form of white noise.

The LP compression approach basically only transmits/stores updates for the (quantized) filter coefficients, the (quantized) residual (waveform or parameters such as pitch), and the (quantized) gain. A receiver regenerates the speech with the same perceptual characteristics as the input speech. FIG. 9 shows the blocks in an LP system. Periodic updating of the quantized items requires fewer bits than direct representation of the speech signal, so a reasonable LP coder can operate at bits rates as low as 2–3 kb/s (kilobits per second).

Indeed, the ITU standard G.729 Annex E with a bit rate of 11.8 kb/s uses LP analysis with codebook excitation (CELP) to compress voiceband speech and has performance comparable to the 64 kb/s PCM used for PSTN digital transmission.

However, the quality of even the G.729 Annex E standard does not meet the demand for high quality speech systems, and various proposals extend the coding to wideband (e.g., 0–7 kHz) speech without too large an increase in transmission bit rate.

The direct approach of applying LP coding to the full 0–8 kHz wideband increases the bit rate too much or degrades the quality. One alternative approach simply extrapolates from the (coded) 0–4 kHz lowband to a create a 4–8 kHz highband signal; see Chan et al, Quality Enhancement of Narrowband CELP-Coded Speech via Wideband Harmonic Re-Synthesis, IEEE ICASSP 1997, pp. 1187–1190. Another approach uses split-band CELP or MPLPC by coding a 4–8 kHz highband separately from the 0–4 kHz lowband and with fewer bits allocated to the highband; see Drogo de Jacovo et al, Some Experiments of 7 kHz Audio Coding at 16 kbit/s, IEEE ICASSP 1989, pp. 192–195. Similarly, Tucker, Low Bit-Rate Frequency Extension Coding, IEE Colloquium on Audio and Music Technology 1998, pp. 3/1–3/5, provides standard coding of the lowband 0–4 kHz plus codes the 4–8 kHz highband speech only for unvoiced frames (as determined in the lowband) and uses an LP filter of order 2–4 with noise excitation.

However, these wideband approaches suffer from either too high a bit rate or too low a quality.

SUMMARY OF THE INVENTION

The present invention provides low-bit-rate wideband embedded speech coding/decoding by use of a partition of the wideband into a lowband with narrowband coding plus a highband with LP coding using an adaptively smoothed modulated noise excitation where the modulation and smoothing derive from the lowband. The bits from the lowband and highband are combined for transmission or storage.

The narrowband coding may be an LP-based voiceband coder; and the highband coding may include spectral reversal so it can effectively use the voiceband coder's quantizer.

This has advantages including the capturing of the quality of wideband speech at low bit rates and the embedding of the voiceband coding in the wideband coding to allow for decoding bit rate choice.

DETAILED DESCRIPTION OF THE PREFERRED EMBODIMENTS

1. Overview

The preferred embodiment systems include preferred embodiment encoders and decoders that process a wideband speech frame as the sum of a lowband signal and a highband signal in which the lowband signal has standalone speech encoding/decoding and the highband signal has encoding/decoding incorporating information from the lowband signal to adaptively modulate a noise excitation. This allows for a minimal number of bits to sufficiently encode the highband and yields an embedded coder.

2. First Preferred Embodiment Systems

Figure 1A:
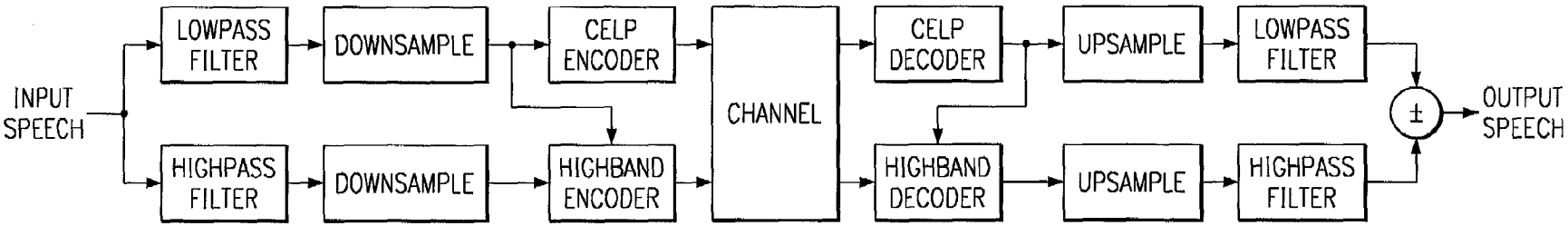
FIGS. 1*a*–1*c* show first preferred embodiments.

FIG. 1*a* shows in functional block format a first preferred embodiment system for wideband speech encoding, transmission (storage), and decoding including first preferred embodiment encoders and decoders. The encoders and decoders use CELP lowband encoding and decoding plus a highband encoding and decoding incorporating information from the (decoded) lowband for modulation of a noise excitation with LP coding.

Figure 1C:
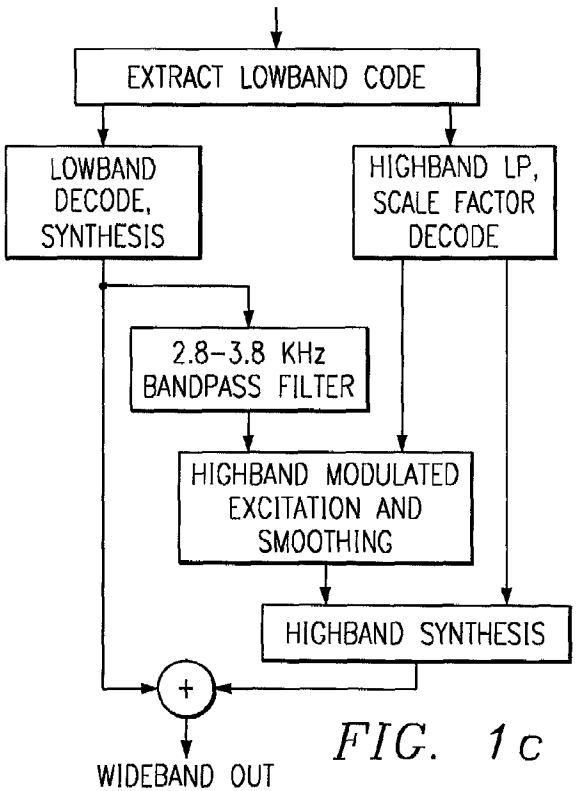
Figure 1B:
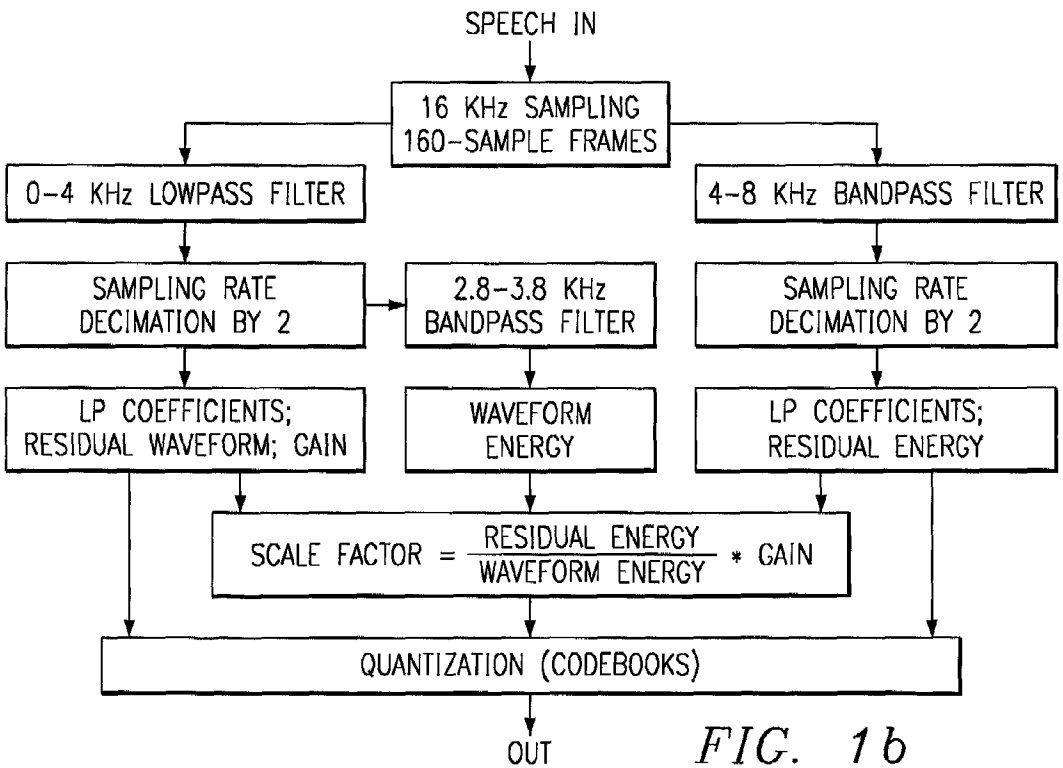
Figure 3B:
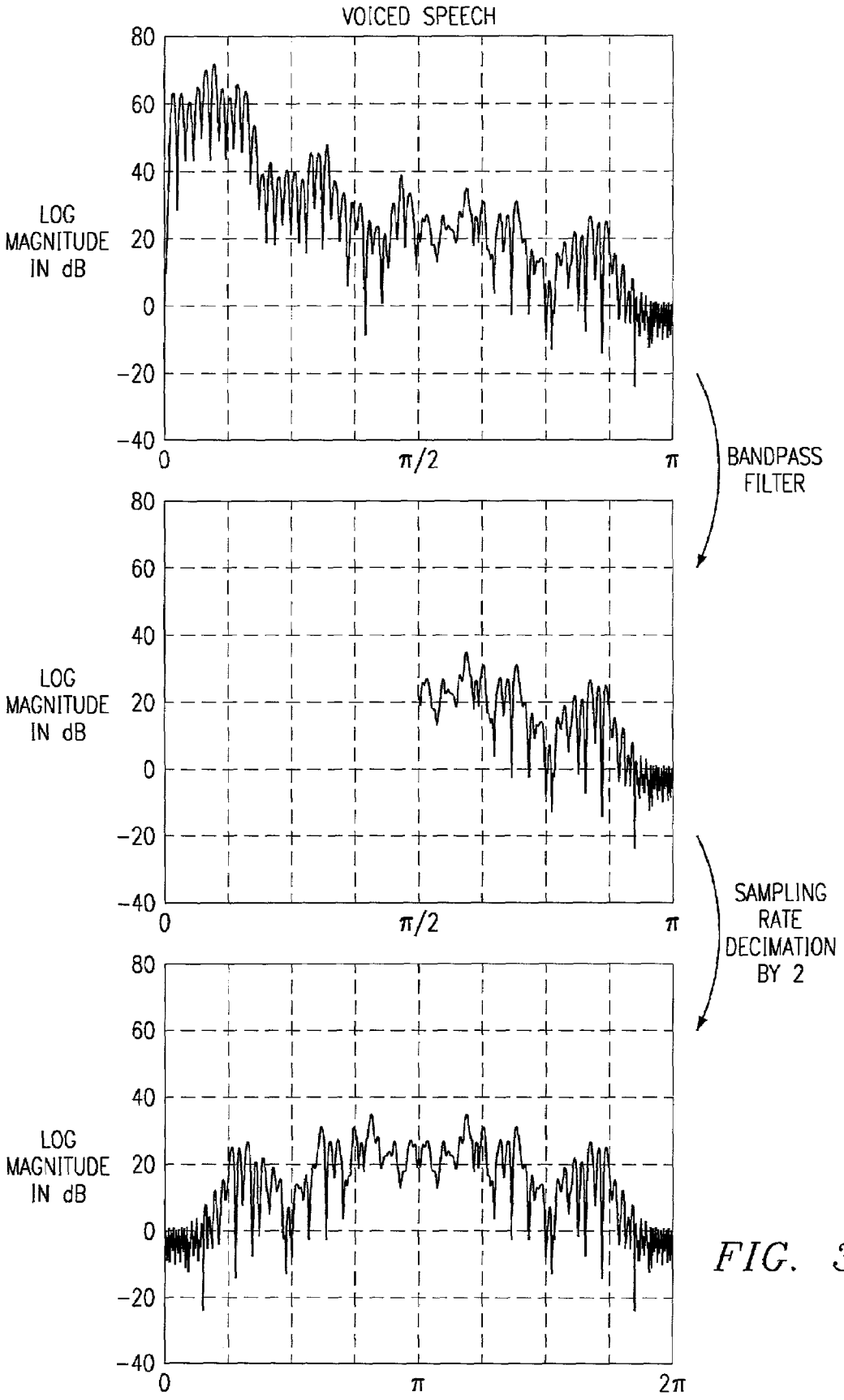
Figure 4A:
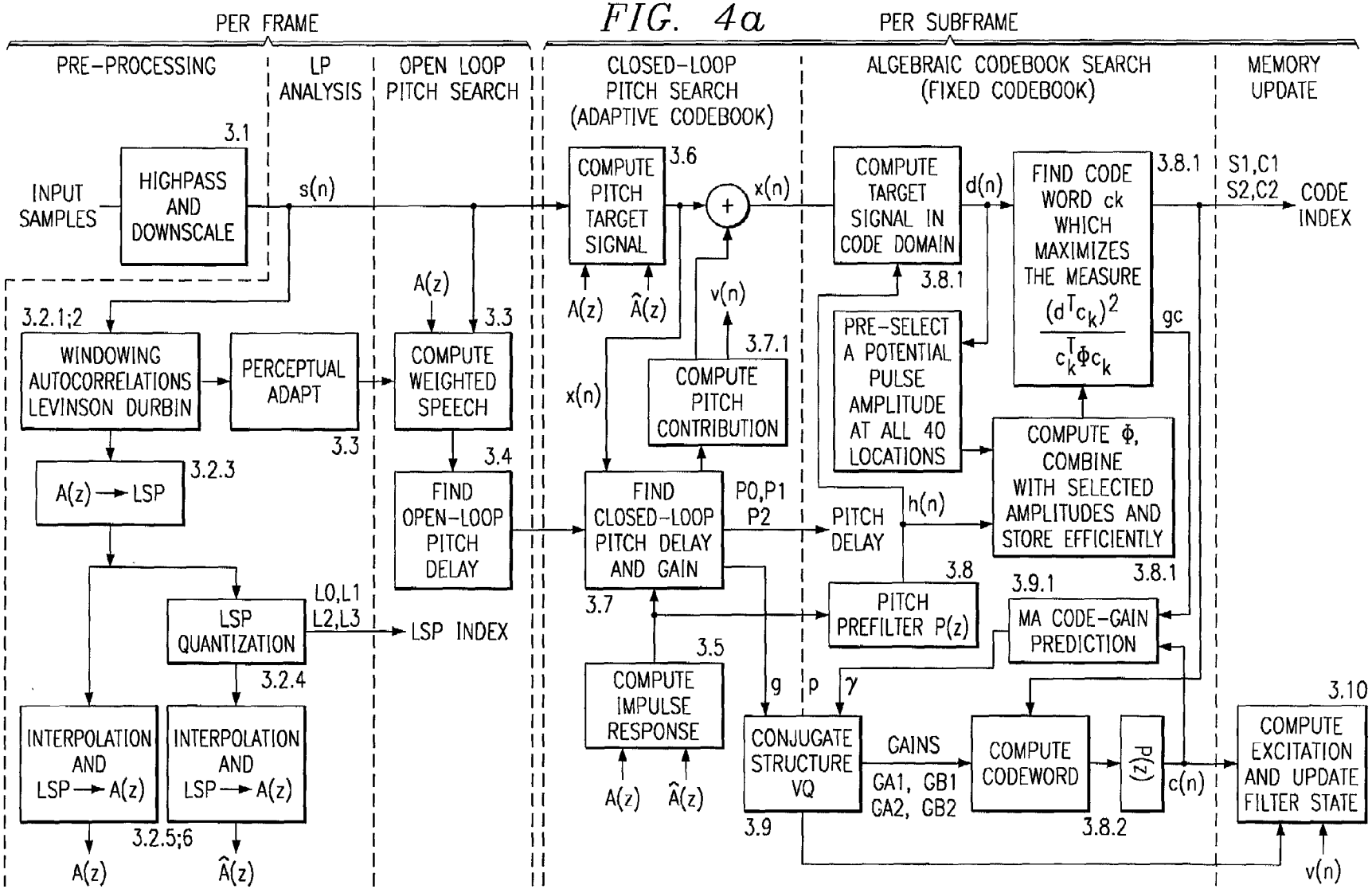
FIGS. 4*a*–4*b* are block diagrams of G.729 encoder and decoder.
Figure 4B:
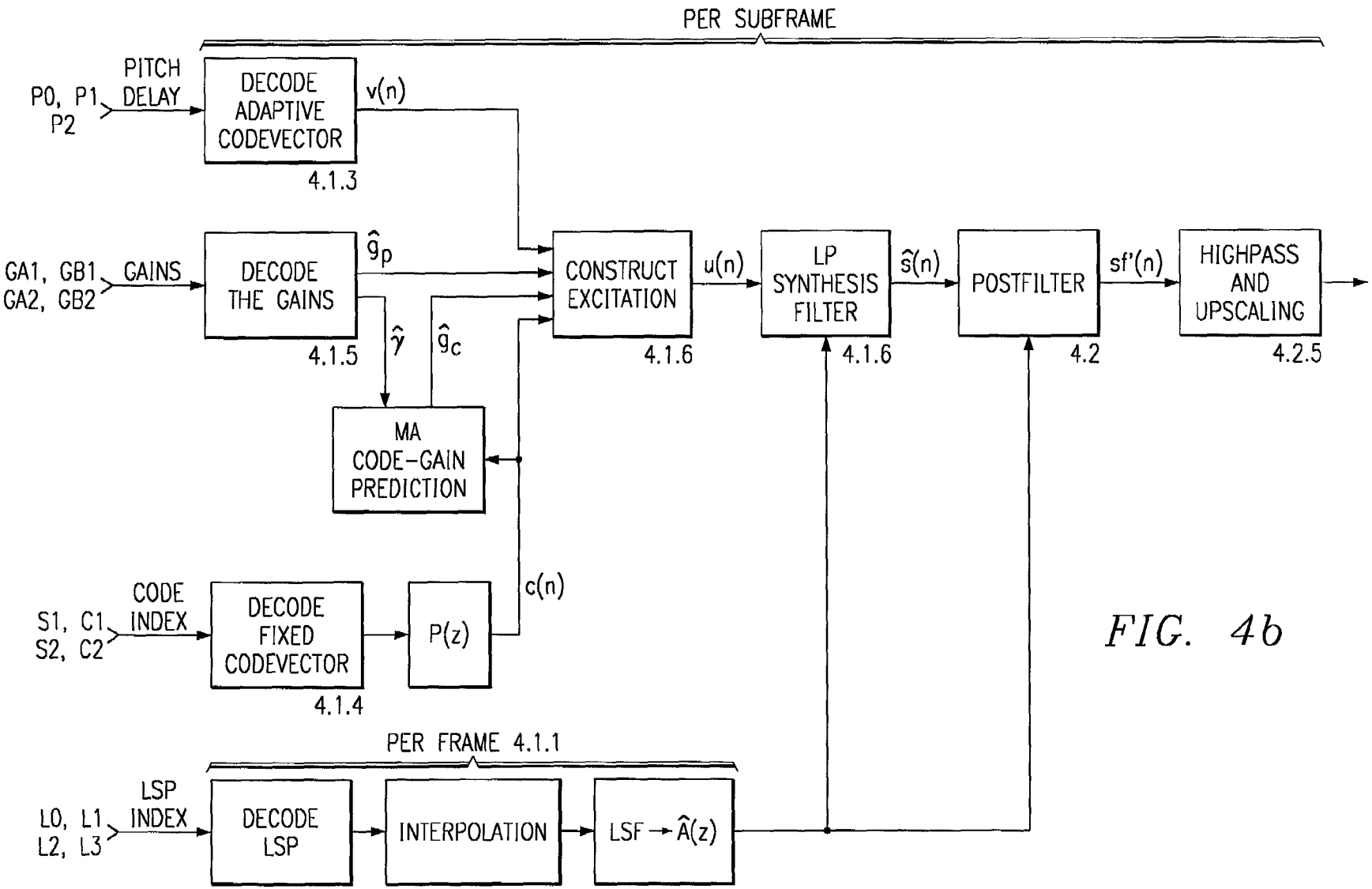

As illustrated in FIG. 1*b*, first preferred embodiment encoders proceed as follows. Half-band filter 0–8 kHz wideband (16 kHz sampling rate) speech into a 0–4 kHz lowband signal plus a 4–8 kHz highband signal, and decimate the original sampling rate of 16 kHz by a factor of 2 for both the lowband and the highband to create two baseband signals each with a 8 kHz sampling rate. (Note that the baseband of the decimated highband has a reversed spectrum because the baseband is an aliased image; see FIG. 3*b*.) Next, encode the first baseband (decimated lowband) signal with a (standard) narrowband speech coder. For example, the ITU G.729 standard 8 kb/s uses 18 bits for quantized LP coefficients (three codebooks) per 10 ms (80 samples) frame, 14 bits for pitch delay (adaptive codebook), 34 bits for delayed excitation differential (fixed codebook), and 14 bits for gains. FIGS. 4*a*–4*b* show block diagrams of the encoder and decoder. G.729 Annex E provides higher quality with a higher bit rate (11.8 kb/s).

Figure 5:
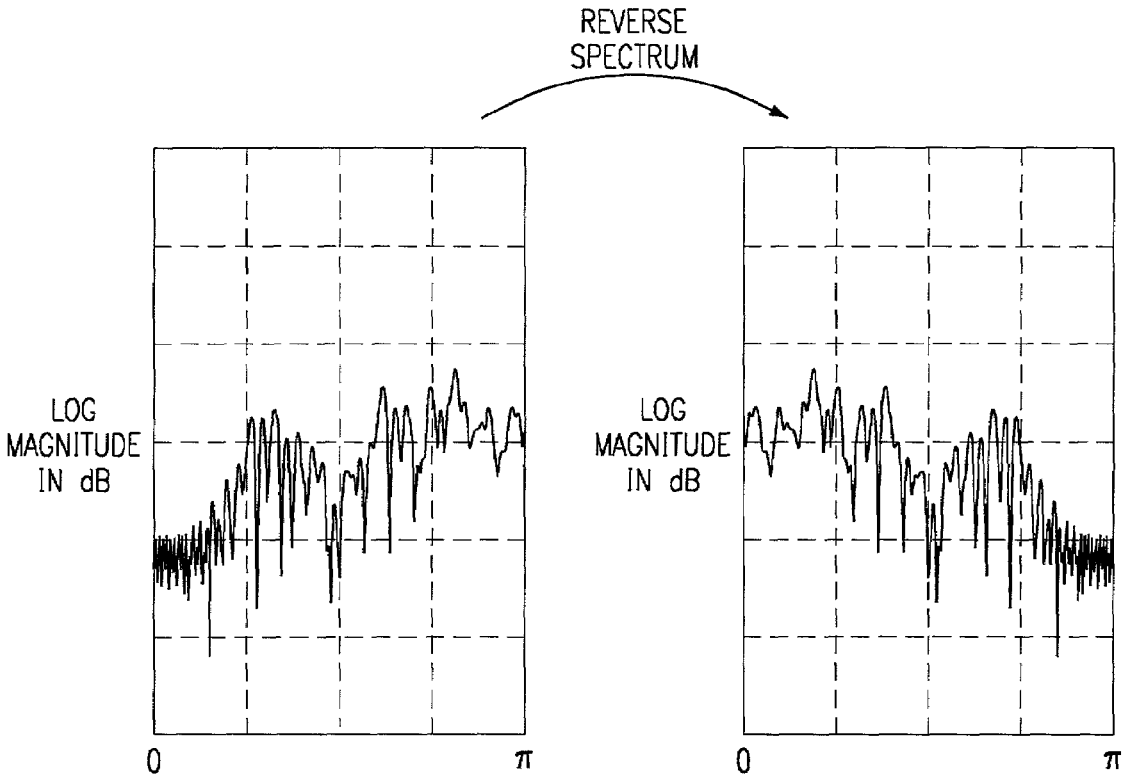
FIG. 5 shows spectrum reversal.

Then reverse (for codebook convenience) the spectrum of the second baseband (decimated highband image) as in FIG. 5 and encode the signal with LP filter coefficients and noise excitation gain for a modulated noise excitation. The preferred embodiments use pitch-modulated noise excitation with the pitch-modulated noise excitation derived from the lowband through multiplying noise by the (envelope of the) 2.8–3.8 kHz subband of the first baseband signal and smoothing depending upon noise level. The normalized (divided by the 2.8–3.8 kHz subband energy) excitation gain simply replaces the excitation gain as would be used for the case of a non-modulated noise excitation; so there is no bit rate increase.

Lastly, combine the lowband and highband codes into a single bitstream which has the lowband code as an embedded substream. The following sections provide more detailed descriptions.

Decoding reverses the encoding process by separating the highband and lowband code, using information from the decoded lowband to help decode the highband, and adding the decoded highband to the decoded lowband speech to synthesize wideband speech. See FIG. 1*c*. This split-band approach allows most of the code bits to be allocated to the lowband; for example, the lowband may consume 11.8 kb/s and the highband may add 2.2 kb/s for a total of 14 kb/s.

The independence of the lowband's code from any highband information allows the narrowband coder bits to be embedded in the overall coder bitstream and to be extractable by a lower-bit-rate decoder for separate decoding. This split-band approach also ensures that a narrowband analog input signal, such as from a traditional telephone line (bandlimited to 3.4 kHz) can still be encoded well with the wideband preferred embodiment coding.

3. Coder Details

Figure 2A:
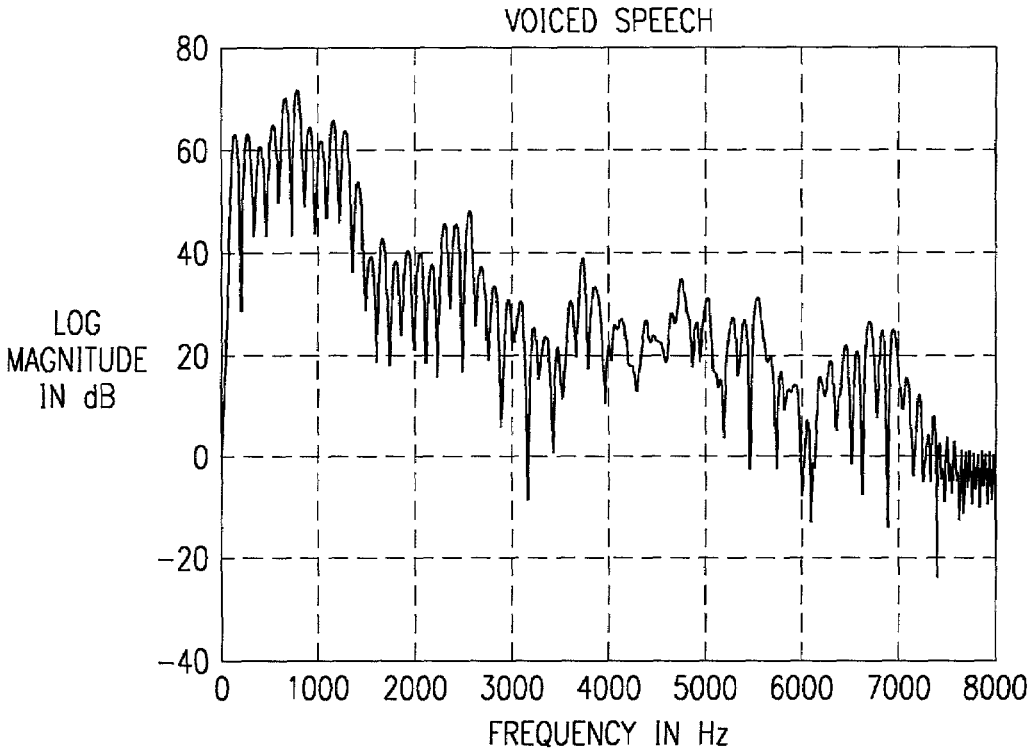
FIGS. 2*a*–2*b* illustrate frequency domain frames.
Figure 2B:
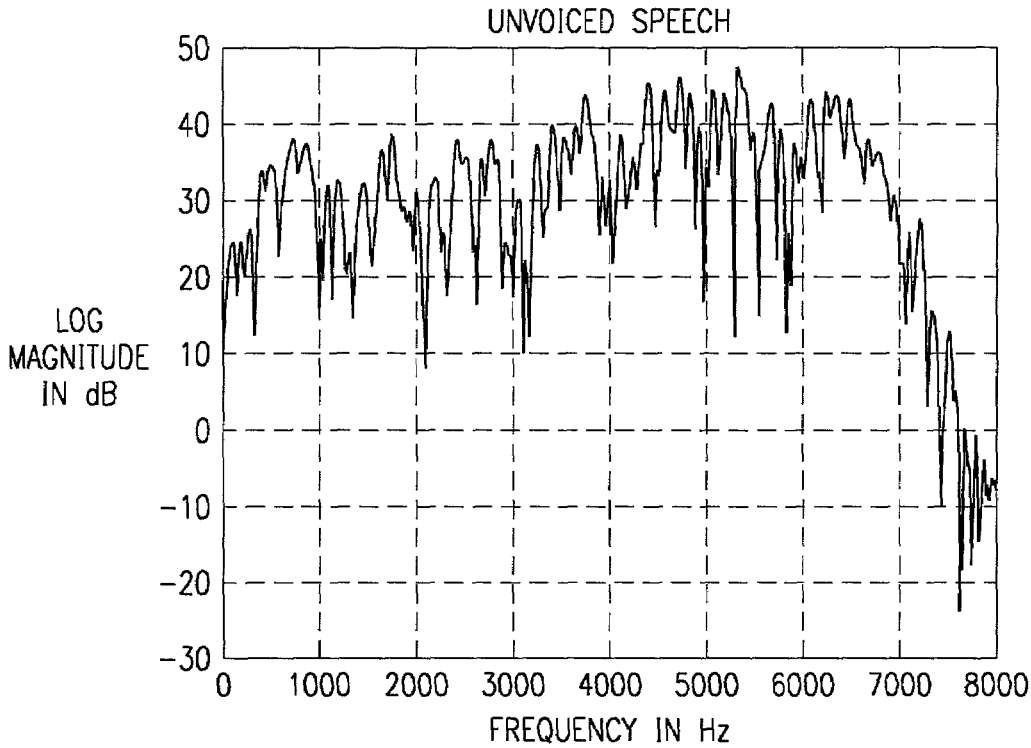

FIGS. 2*a*–2*b* illustrate the typical magnitudes of voiced and unvoiced speech, respectively, as functions of frequency over the range 0–8 kHz. As FIG. 2*a* shows, the bulk of the energy in voiced speech resides in the 0–3 kHz band. Further, the pitch structure (the fundamental frequency is about 125 Hz in FIG. 2*a*) clearly appears in the range 0–3.5 kHz and persists (although jumbled) at higher frequencies. But the perceptual critical bandwidth at higher frequencies is roughly 10% of a band center frequency, so the individual pitch harmonics become indistinguishable and should require fewer bits for inclusion in a highband code.

In contrast, FIG. 2*b* shows unvoiced-speech energy peaks in the 3.5–6.5 kHz band. However, the precise character of this highband signal contains little perceptual information.

Consequently, the higher band (above 4 kHz) should require fewer bits to encode than the lower band (0–4 kHz). This underlies the preferred embodiment methods of partitioning wideband (0–8 kHz) speech into a lowband (0–4 kHz) and a highband (4–8 kHz), recognizing that the lowband may be encoded by any convenient narrowband coder, and separately coding the highband with a relatively small number of bits as described in the following sections.

FIG. 1*b* illustrates the flow of a first preferred embodiment speech encoder which encodes at 14 kb/s with the following steps.

(1) Sample an input wideband speech signal (which is bandlimited to 8 kHz) at 16 kHz to obtain a sequence of wideband samples, wb(n). Partition the digital stream into 160-sample (10 ms) frames.

Figure 3A:
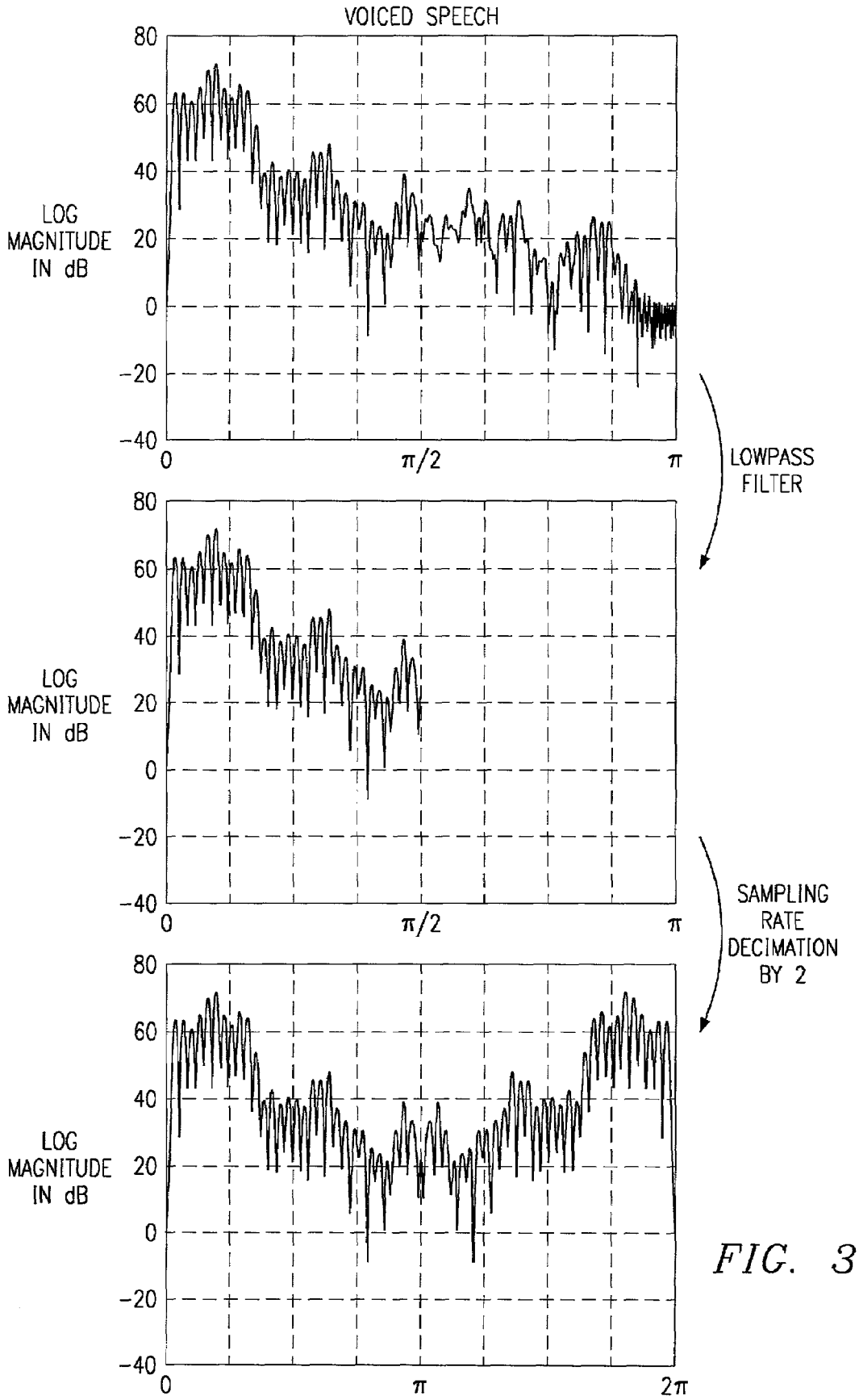
FIGS. 3*a*–3*b* show filtering.

(2) Lowpass filter wb(n) with a passband of 0–4 kHz to yield lowband signal lb(n) and (later) also highpass filter wb(n) with a passband of 4–8 kHz to yield highband signal hb(n); this is just half-band filtering. Because both lb(n) and hb(n) have bandwidths of 4 kHz, the sampling rate of 16 kHz of both lb(n) and hb(n) can be decimated by a factor of 2 to a sampling rate of 8 kHz without loss of information. Thus let lbd(m) denote the baseband (0–4 kHz) version of lb(n) after decimation of the sampling rate by a factor of 2, and similarly let hbdr(m) denote the baseband (0–4 kHz) version of hb(n) after decimation of the sampling rate by a factor of 2. FIGS. 3*a*–3*b* illustrate the formation of lbd(m) and hbdr(m) in the frequency domain for a voiced frame, respectively; note that $\pi$ on the frequency scale corresponds to one-half the sampling rate. The decimation by 2 creates spectrally reversed images, and the baseband hbdr(m) is reversed compared to hb(n). Of course, lbd(m) corresponds to the traditional 8 kHz sampling of speech for digitizing voiceband (0.3–3.4 kHz) analog telephone signals.

(3) Encode lbd(m) with a narrowband coder, for example the ITU standard 11.8 kb/s G.729 Annex E coder which provides very high speech quality as well as relatively good performance for music signals. This coder may use 80-sample (10 ms at a sampling rate of 8 kHz) frames which correspond to 160-sample (10 ms at a sampling rate of 16 kHz) frames of wb(n). This coder uses linear prediction (LP) coding with both forward and backward modes and encodes a forward mode frame with 18 bits for codebook quantized LP coefficients, 14 bits for codebook quantized gain (7 bits in each of two subframes), 70 bits for codebook quantized differential delayed excitation (35 bits in each subframe), and 16 bits for codebook quantized pitch delay and mode indication to total 118 bits for a 10 ms frame. A backward mode frame is similar except the 18 LP coefficient bits are instead used to increase the excitation codebook bits to 88.

(4) Using lbd(m), prepare a pitch-modulation waveform similar to that which will be used by the highband decoder as follows. First, apply a 2.8–3.8 kHz bandpass filter to the baseband signal lbd(m) to yield its high portion, lbdh(m). Then take the absolute value, ||lbdh(m)|; a signal similar to this will be used by the decoder as a multiplier of a white-noise signal to be the excitation for the highband. Decoder step (5) in the following section provides more details.

(5) If not previously performed in step (2), highpass filter wb(n) with a passband of 4–8 kHz to yield highband signal hb(n), and then decimate the sampling rate by 2 to yield hbdr(m). This highband processing may follow the lowband processing (foregoing steps (2)–(4)) in order to reduce memory requirements of a digital signal processing system.

(6) Apply LP analysis to hbdr(m) and determine (highband) LP coefficients $a_{HB}(j)$ for an order M=10 filter plus estimate the energy of the residual $r_{HB}(m)$. The energy of $r_{HB}$ will scale the pitch-modulated white noise excitation of the filter for synthesis.

(7) Reverse the signs of alternate highband LP coefficients: this is equivalent to reversing the spectrum of hbdr (m) to hbd(m) and thereby relocating the higher energy portion of voiced frames into the lower frequencies as illustrated in FIG. 5. Energy in the lower frequencies permits effective use of the same LP codebook quantization used by the narrowband coder for lbd(m). In particular, voiced frames have a lowpass characteristic and codebook quantization efficiency for LSFs relies on such characteristic: G.729 uses split vector quantization of LSFs with more bits for the lower coefficients. Thus determine LSFs from the (reversed) LP coefficients $\pm a_{HB}(j)$, and quantize with the quantization method of the narrowband coder for lbd(m) in step (4).

Alternatively, first reverse the spectrum of hbdr(m) to yield hbd(m) by modulating with a 4 kHz square wave, and then perform the LP analysis and LSF quantization. Either approach yields the same results.

(8) The excitation for the highband synthesis will be noise modulated (multiplied) by a scaled estimate of ||lbdh(m)| where the scaling is set to have the excitation energy equal to the energy of the highband residual $r_{HB}(m)$ and the scaled modulation signal is then smoothed according to noise levels. Thus normalize the residual energy level by dividing the energy of the highband residual by the energy of ||lbdh(m)||; ||lbdh(m)| was determined in step (4). Lastly, quantize this normalized energy of the highband residual in place of the (non-normalized) energy of the highband residual which would be used for excitation when the pitch-modulation is omitted. That is, the use of pitch modulation for the highband excitation requires no increase in coding bits because the decoder derives the pitch modulation from the decoded lowband signal, and the energy of the highband residual takes the same number of coding bits whether or not normalization has been applied.

(9) Combine the output bits of the baseband lbd(m) coding of step (4) and the output bits of hbd(m) coding of steps (7–8) into a single bitstream. Note that all of the items quantized typically would be differential values in that the preceding frame's values would be used as predictors, and only the differences between the actual and the predicted values would be encoded.

4. Decoder Details

A first preferred embodiment decoding method essentially reverses the encoding steps for a bitstream encoded by the first preferred embodiment method and includes a smoothing of the pitch-modulated noise highband excitation. Generally, decoding encoded clean input speech yields high-quality even at low bit rates. However, in the presence of noise, there is audible degradation due in part to the encoding of the modulating signal for the highband synthesis excitation. In the presence of noise, at the lower bit rates, the lowband encoder does not do a very accurate job of encoding the 2.8–3.8 KHz band. As a result the output time-domain signal in this band is more erratic (shows more rapid time variation) than the input signal. This, in turn, causes the highband signal (obtained by sample-by-sample multiplication of the envelope signal and the random noise) to show rapid amplitude variations, which are perceived as busy high-frequency noise upon listening. The preferred embodiments preserve the high quality in clean speech and improve the quality in the presence of noise by application of a smoothing to the modulating signal depending upon a noise level estimated from the synthesized lowband speech. This creates a more slowly varying envelope signal in the presence of background noise and reduces the annoying "busy" noise. In particular, FIG. 1*c* illustrates decoding:

(1) Extract the lowband code bits from the bitstream and decode (using the G.729 decoder) to synthesize lowband speech lbd'(m), an estimate of lbd(m).

(2) Bandpass filter (2.8–3.8 kHz band) the synthesized lowband speech lbd'(m) to yield lbdh'(m) and compute the absolute value ||lbdh'(m)| as in the encoding; this will be used to pitch-modulate noise to generate the highband excitation.

[following steps (3),(4),(5), (8), and part of (9) are new]

(3) Compute the signal level over the subframe estimate slbdh' for lbdh'(m) from step (2) in the following manner (i) initialize slbdh'=0

(ii) for each subframe (a) $tmp=10 \log_{10}(\Sigma lbdh'(m)^2)$ (b) $slbdh'=\gamma * slbdh'+(1-\gamma)*tmp$, where $0<\gamma<1$ (4) Update the noise level over the subframe estimate nlbdh' for lbdh'(m) from step (2) (the 2.8–3.8 kHz band of the synthesized lowband). In particular, nlbdh' is computed using slbdh' in the following manner (i) during initialization period, set nlbdh' to the input subframe's energy (ii) for each subsequent subframe (a) if slbdh'>nlbdh'+T_up, nlbdh'=nlbdh'+T_up (b) if slbdh'<nlbdh'−T_down, nlbdh'=nlbdh'−T_down (c) else, nlbdh'=slbdh'

(d) if nlbdh'>nlbdh_max, nlbdh'=nlbdh_max (e) if nlbdh'<nlbdh_min, nlbdh'=nlbdh_min Here, T_up (e.g. 3 dB per second) and T_down (e.g. 12 dB per second) are positive and negative power increment thresholds, and nlbdh_min (e.g. 5 dB) and nlbdh_max (e.g. 80 dB) and minimum and maximum allowed noise level estimates. nlbdh' will be used to define the smoothing for the pitch-modulated noise in step (8).

(5) Compare slbdh' and nlbdh' and determine a smoothing factor $\alpha$ to be used in step (8) as follows:

(i) slbdh'/nlbdh'≧15 dB, take $\alpha=0$. [a hangover could be applied here, meaning that $\alpha$ is kept at zero for a few frames even though the slbdh'/nlbdh' ratio may drop below 15 dB]

(ii) 15 dB>slbdh'/nlbdh'≧5 dB, take $\alpha=0.95$.

(iii) 5 dB>slbdh'/nlbdh', take $\alpha=0.99$.

(6) Extract the highband code bits, decode the quantized highband LP coefficients (derived from hbd(m)) and the quantized normalized excitation energy level (scale factor). Frequency reverse the LP coefficients (alternate sign reversals) to have the filter coefficients for an estimate of hbdr(m).

(7) Scale ||lbdh'(m)| by the scale factor decoded in step (6) to obtain sc_lbdh'(m). The scale factor may be interpolated (using the adjacent frame's scale factor) every 20-sample subframe to yield a smoother scale factor.

(8) Define the smoothed pitch-modulating waveform for the current (nth) frame, sm[n](m), using α from step (5) and linearly interpolating:

$$sm[n](m)=\alpha*sm[n-1](m)+(1-\alpha)*sc_lbdh'(m)$$

Figure 6:
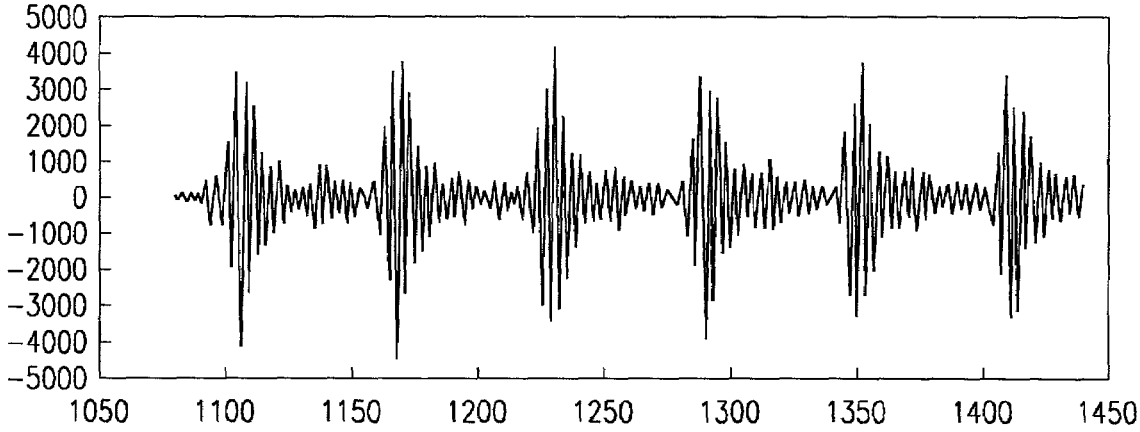
FIGS. 6–7 are the high portion of a lowband for a voiced frame and the envelope.

(9) Generate white noise and modulate (multiply) this noise by waveform sm[n](m) from (8) to form the highband excitation. FIG. 6 illustrates an exemplary lbdh'(m) for a voiced frame. In the case of unvoiced speech, the periodicity would generally be missing and lbdh'(m) would be more uniform and not significantly modulate the white-noise excitation.

The periodicity of lbdh'(m) roughly reflects the vestigial periodicity apparent in the highband portion of FIG. 2*a* and missing in FIG. 2*b*. This pitch modulation will compensate for a perceived noisiness of speech synthesized from a pure noise excitation for hbd(m) in strongly-voiced frames. The estimate uses the periodicity in the 2.8–3.8 kHz band of lbd'(m) because strongly-voiced frames with some periodicity in the highband tend to have periodicity in the upper frequencies of the lowband.

(10) Synthesize highband signal hbdr'(m) by using the frequency-reversed highband LP coefficients from (6) together with the adaptively smoothed modulated scaled noise from (9) as the excitation. The LP coefficients may be interpolated every 20 samples in the LSP domain to reduce switching artifacts.

(11) Upsample (interpolation by 2) synthesized (decoded) lowband signal lbd'(m) to a 16 kHz sampling rate, and lowpass filter (0–4 kHz band) to form lb'(n). Note that interpolation by 2 forms a spectrally reversed image of lbd'(m) in the 4–8 kHz band, and the lowpass filtering removes this image.

(12) Upsample (interpolation by 2) synthesized (decoded) highband signal hbdr'(m) to a 16 kHz sampling rate, and highpass filter (4–8 kHz band) to form hb'(n) which reverses the spectrum back to the original. The highpass filter removes the 0–4 kHz image.

(13) Add the two upsampled signals to form the synthesized (decoded) wideband speech signal: wb'(n)=lb'(n)+hb'(n).

5. System Preferred Embodiments

Figure 8:
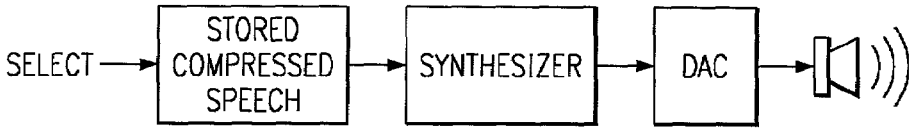
FIGS. 8–9 are block diagrams of systems.
Figure 9:
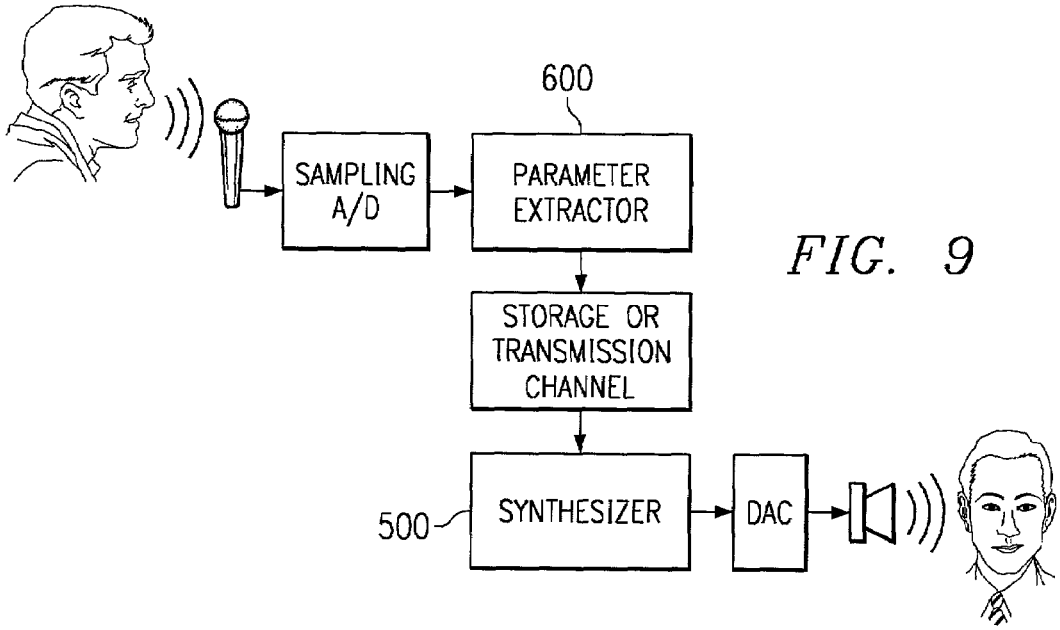

FIGS. 8–9 show in functional block form preferred embodiment systems which use the preferred embodiment encoding and decoding. The encoding and decoding can be performed with digital signal processors (DSPs) or general purpose programmable processors or application specific circuitry or systems on a chip such as both a DSP and RISC processor on the same chip with the RISC processor controlling. Codebooks would be stored in memory at both the encoder and decoder, and a stored program in an onboard ROM or external flash EEPROM for a DSP or programmable processor could perform the signal processing. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

6. Second Preferred Embodiments

Figure 7:
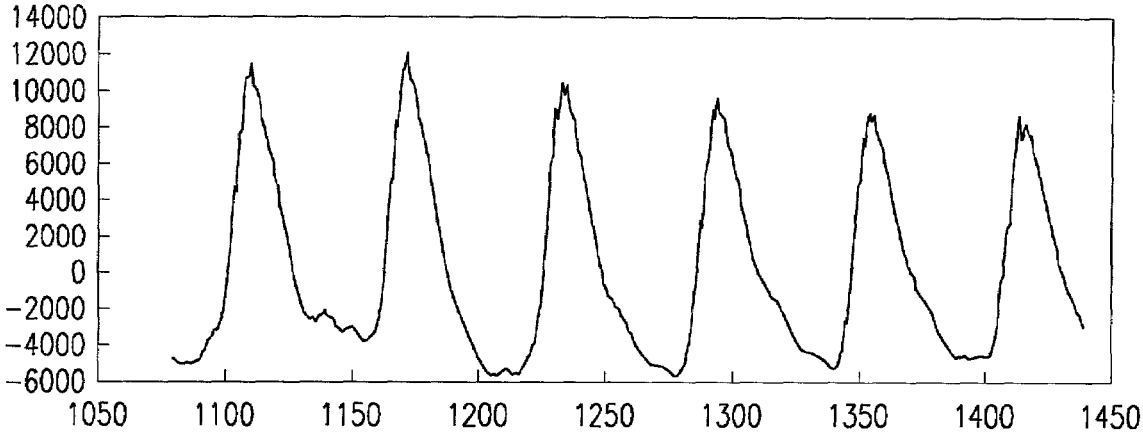

Second preferred embodiment coders and decoders follow the first preferred embodiment coders and decoders and partition the sampled input into a lowband and a highband, downsample, and apply a narrowband coder to the lowband. However, the second preferred embodiments vary the encoding of the highband with modulated noise-excited LP by deriving the modulation from the envelope of lbdh(m) rather than its absolute value. In particular, find the envelope en(m) of lbdh(m) by lowpass (0–1 kHz) filtering the absolute value |lbdh(m)| plus notch filtering to remove dc. FIG. 7 illustrates en(m) for the voiced speech of FIG. 6 in the time domain. Again, apply smoothing according to the noise level.

7. Modifications

The preferred embodiments may be modified in various ways while retaining the features of separately coding a lowband from a wideband signal and using information from the lowband to help encode the highband (remainder of the wideband) plus apply smoothing according to noise levels.

For example, the upper (2.8–3.8 kHz) portion of the lowband (0–4 kHz) could be replaced by some other portion (s) of the lowband for use as a modulation for the highband excitation. And the smoothing interpolation factor α could be defined with differing signals and techniques. For instance, one could use the entire lowband decoded signal, or the transmitted highband gain levels. What matters is that there be some way to estimate the relative levels of noise and speech. Also, the signal to noise estimate ratios used to change α values and the values themselves could be varied; indeed, α could have a linear or quadratic or other functional dependence upon the signal and noise estimates.

Further, the highband encoder/decoder may have its own LP analysis and quantization, so the spectral reversal would not be required; the wideband may be partitioned into a lowband plus two or more highbands; the lowband coder could be a parametric or even non-LP coder and a highband coder could be a waveform coder; and so forth.

What is claimed is:

1. A method of wideband speech decoding, comprising:

(a) decoding a first portion of an input signal as a lowband speech signal;

(b) decoding a second portion of an input signal as a noise-modulated excitation of a linear prediction encoding wherein said noise modulated excitation is noise modulated by a portion of the results of said decoding as a lowband speech signal of preceding step (a) and adaptively smoothed; and (c) combining the results of foregoing steps (a) and (b) to form a decoded wideband speech signal.

2. The method of claim 1, wherein:

(a) said decoding of step (a) of claim 1 includes:

(i) extracting a lowband linear prediction filter from said input signal, (ii) extracting a lowband excitation from said input signal, (iii) extracting a lowband gain from said input signal, (iv) applying said lowband excitation to said lowband linear prediction filter, and (v) applying said gain to results of said step (iv); and (b) said decoding of step (b) of claim 1 includes:

(vi) extracting a highband linear prediction filter from said input signal, (vii) extracting a highband scale factor from said input signal.

(viii) bandpass filtering the results of said step (v), (ix) applying said highband scale factor to the results of said step (viii), (x) smoothing the results of said step (ix) with prior decoding results, (xi) modulating noise with the results of said step (x), and (xii) applying the results of said step (xi) to said highband linear prediction filter.

3. The method of claim 2, wherein:

(a) said step (b) of claim 3 includes smoothing said highband scale factor wit prior decoding results.

4. A wideband speech decoder, comprising:

(a) a first speech decoder with an input for encoded narrowband speech;

(b) a second speech decoder with an input for encoded highband speech and an input for the output of said first speech decoder, said second speech decoder using excitation of noise modulated by a portion of the output of said first speech decoder and adaptively smoothed; and (c) a combiner for the outputs of said first and second speech decoders to output decoded wideband speech.

5. The decoder of claim 4, wherein:

(a) said first decoder of step (a) of claim 2 uses:

(i) extraction of a lowband linear prediction filter from input, (ii) extraction of a lowband excitation from input, (iii) extraction of a lowband gain from input, (iv) application of said lowband excitation to said lowband linear prediction filter, and (v) application of said gain to results of said application (iv); and (b) said second decoder of step (b) of claim 1 uses:

(vi) extraction of a highband linear prediction filter from input, (vii) extraction of a highband scale factor from input.

(viii) bandpass filtering of the results of said application (v), (ix) application of said highband scale factor to the results of said bandpass filtering (viii), (x) smoothing of the results of said application (ix) with prior decoding results.

(xi) modulation of noise with the results of said smoothing (x), and (xii) application of the results of said modulation (xi) to said highband linear prediction filter.

6. The decoder of claim 5, wherein:

(a) said second decoder of (b) of claim 5 uses smoothing of said highband scale factor with prior decoding results.

* * * * *